United States Patent [19]

Ellis

[11] 4,363,358

[45] Dec. 14, 1982

[54] SUBSURFACE TUBING HANGER AND STINGER ASSEMBLY

[75] Inventor: Gary D. Ellis, Richardson, Tex.

[73] Assignee: Dresser Industries, Inc., Dallas, Tex.

[21] Appl. No.: 264,993

[22] Filed: May 18, 1981

Related U.S. Application Data

[62] Division of Ser. No. 117,585, Feb. 1, 1980, Pat. No. 4,305,465.

[51] Int. Cl.[3] ..... E21B 33/128; E21B 33/129

[52] U.S. Cl. ..... 166/212; 166/217; 166/181; 166/242

[58] Field of Search ..... 166/217, 120, 125, 242, 166/181, 212

[56] References Cited

U.S. PATENT DOCUMENTS

| | | | |
|---|---|---|---|
| 3,050,128 | 8/1962 | Brown | 166/120 |
| 3,241,616 | 3/1966 | Cox | 166/139 |
| 3,282,342 | 11/1966 | Mott | 166/120 |
| 3,433,506 | 3/1969 | Crowe | 166/242 |
| 4,051,894 | 10/1977 | Goad | 166/73 |
| 4,146,093 | 3/1979 | Horvath et al. | 166/120 |
| 4,258,792 | 3/1981 | Restarick | 166/242 |
| 4,281,858 | 8/1981 | Bowyer | 166/242 |
| 4,289,202 | 9/1981 | Henderson | 166/125 |

*Primary Examiner*—James A. Leppink
*Assistant Examiner*—William P. Neuder
*Attorney, Agent, or Firm*—J. N. Hazelwood; W. R. Peoples

[57] ABSTRACT

A hanger and stinger assembly includes an expandable joint therebetween for the stinger to be telescoped with the hanger between extended and collapsed positions. An actuating spool for use in conjunction with a wireline tool mechanism is provided for hydraulically actuating the slips on the hanger and a releasable catch is connected between the stinger and a tubular receptacle mounted on the hanger to normally limit upward movement of the stinger to its extended position. A latch at the upper end of the stinger is utilized to hold the catch in a release position enabling the stinger to be withdrawn from the receptacle by a straight pull and a locking mechanism normally positions the latch to keep from holding the catch in its release position and the locking mechanism is hydraulically actuated.

17 Claims, 13 Drawing Figures

SUBSURFACE TUBING HANGER AND STINGER ASSEMBLY

This is a division of application Ser. No. 117,585, filed Feb. 1, 1980, now U.S. Pat. No. 4,305,465.

TECHNICAL FIELD

This invention relates generally to oil and/or gas well production apparatus and, more particularly, to a subsurface tubing hanger such as may be disposed in an offshore well beneath a subsurface safety valve.

BACKGROUND ART

In well production apparatus and particularly that used in offshore wells, a subsurface safety valve may be installed in the tubing string to provide a means by way of which fluid flow to the head of the well may be cut-off beneath the sea floor should it become necessary to do so. Typically, such safety valves are maintained open for fluid flow to the well head through the use of a control pressure communicated to a safety valve through a control line extending from the well head to the valve. A surface hanger supports an upper section of the tubing string extending downwardly through the well casing from the well head and connecting to the safety valve. Beneath the safety valve, a lower section of the tubing string is suspended in the casing by a subsurface tubing hanger. When set in the casing, hydraulically actuated slips protrude radially from the hanger to embed in the interior wall of the casing to support the lower section of the tubing string upwardly within the casing. U.S. Pat. No. 3,874,446 discloses one form of a tubing hanger having hydraulically actuated slips.

Additional support for the tubing string may be provided between the casing and the tubing string by vertically spaced sets of packers such as may be installed in the casing in a permanent or semi-permanent fashion. It is important when installing the tubing string in the well that the upper section of the tubing string be supported entirely by the surface hanger and associated sealing members to insure proper sealing between the tubing string and inside of the casing. Also, it is important that the lower section of the tubing string be supported by the subsurface hanger without weight from the lower section of the tubing string being carried by the surface hanger. Before the subsurface hanger is set within the casing, the weight of the lower section of the tubing stretches the upper section of tubing a finite amount, dependent in part upon the elasticity of the material from which the upper section of tubing is formed. Accordingly, when setting the subsurface hanger, the latter is positioned in the casing upwardly of its position with the tubing stretched and is set to carry the weight of the lower section of tubing. Thereafter, the upper section of tubing is lowered to seat the sealing members with the tubing contracting some extent. To allow for this without imposing a lifting force upon either the subsurface hanger or the surface hanger, an expandable joint is provided in the upper section of the tubing.

One type of well production apparatus of the foregoing general character is disclosed in U.S. Pat. No. 4,051,894. In this prior art apparatus, an expandable joint in the form of a rotational spacer is attached to the lower end of a safety valve and a seal assembly including a seal assembly body or stinger is telescoped with a receptacle connected to the upper end of a subsurface tubing hanger. Adjustment of the length of the spacer is achieved by relative rotation of the safety valve and spacer.

DISCLOSURE OF INVENTION

The present invention contemplates the provision of a unique subsurface tubing hanger and stinger assembly defining an expandable joint therebetween with the stinger being telescoped relative to the hanger and slideable axially between extended and collapsed positions for selective adjustment of the axial length of the joint by merely setting down upon or lifting the tubing string within which the assembly is mounted. Additionally, a releasable catch connected between the stinger and the hanger is movable between a locked position with the stinger blocked against axial separation from the hanger and an unlocked position releasing the stinger for axial separation from the hanger so that the upper section of the tubing string may be pulled from the well for servicing or replacing the safety valve without disturbing the lower section of the tubing string which is suspended from the hanger. A unique latch carried by the stinger connects with the catch to hold the latter in its unlocked position and is actuated hydraulically in a novel manner enabling the latch to connect with the catch by merely setting down on the upper section of the tubing string whereafter the tubing string and accompanying safety valve may be lifted with a straight pull from the well.

A more detailed aspect of the present invention resides in the novel construction of the latch and hydraulically-actuated means for setting the latch to connect with the catch. Advantageously, the hydraulically-actuated means is constructed to avoid inadvertent actuation, such as might otherwise be caused by high pressures in the stinger, through the provision of normally pressure-balance chambers on opposite sides of an actuating piston. Through the use of a simple but novel line tool normal communication between the chambers is blocked with one of the chambers being vented and the other being connected to a high pressure source for shifting the piston and thereby setting the latch for connection with the catch.

Similarly, the invention resides in a new and improved tubing hanger construction insuring against inadvertent setting of the slips and also providing an arrangement whereby the hanger may be released and reset without having to remove the tubing string from the well casing. Herein, a setting cylinder is telescoped over a hanger mandrel with opposed pressure chambers disposed between the mandrel and cylinder. Between the mandrel and cylinder, the chambers are sealed from each other for pressure shifting of the cylinder to move the tubing hanger slips between retracted and set positions. Axially-spaced ports formed through the side of mandrel normally provide for balanced-pressure communication between the two chambers and thus prevent inadvertent shifting of the cylinder due to unexpected high pressure within the mandrel. To set the slips, however, a unique actuating spool, such as may be carried on a wireline tool mechanism, is positioned within the hanger to block normal communication between the two ports and their associated pressure chambers. A first passage through the spool communicates one of the pressure chambers with a high pressure source for setting the slips while a second passage communicates with the other chamber for venting purposes. For retracting the slips a retracting spool is similarly positioned in the hanger but with a high pressure passage communicating with the previously vented chamber and a discharge passage communicating with the previously pressurized chamber.

A further advantage of the present invention resides in the substantially simplified procedures that may be employed at a well when initially installing a tubing hanger and stinger assembly of the present type and in the additional similarly simplified steps that may be taken in servicing and/or replacing a safety valve in a well containing the exemplary tubing hanger and stinger assembly. More specifically, when completing a well for production, the tubing string containing the safety valve, stinger and hanger assembly may be lowered in the well until the seals at the well head seat. Thereafter, the hanger is positioned in the casing by lifting the tubing string a distance sufficient to compensate at least for the elasticity of the upper section of the tubing string. In this position, the actuating spool is lowered and located in the hanger for pressurizing the slip setting chamber to set the slips against the inside of the casing. Once set, the tubing string is simply lowered again until the seals at the well head seat and at the same time the stinger telescopes into an expansion receptacle on the hanger. Should it be necessary to reposition the hanger, the retracting spool is positioned in the tubing hanger for pressurizing the discharge chamber to retract the slips and thereby enable the hanger to be moved within the casing to another position.

For servicing or replacement of the safety valve in the well, a number of steps including hydraulically setting of the latch into a position for interlocking with the catch and lowering of the tubing string for the latch and catch to interlock are required before straight pull lifting the tubing string from the well. Advantageously, however, the present invention also provides for unique construction of the hanger and stinger assembly permitting the stinger to be separated from the hanger by turning the upper section of the tubing string.

These and other novel aspects and advantages of the present invention will become more readily apparent from the following description of the invention when taken in conjunction with the accompanying drawings.

BEST MODE OF CARRYING OUT THE INVENTION

Figure 1:
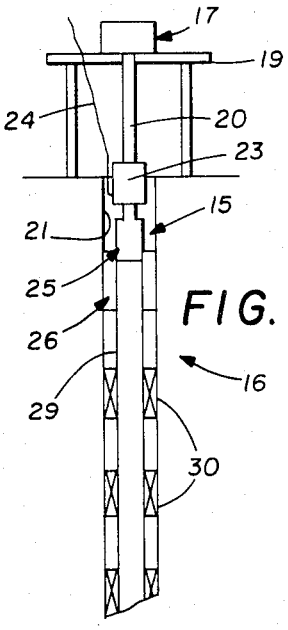
FIG. 1 is a schematic illustration of an offshore well containing a tubing hanger and stinger assembly embodying the novel features of the present invention.
Figure 5:
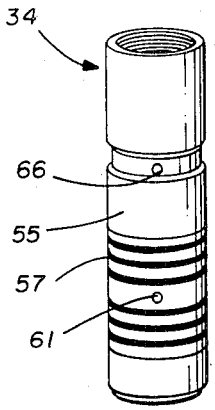
FIG. 5 is a perspective view of an actuating spool of the line tool mechanism.

As shown in the drawings for purposes of illustration, the present invention is embodied in a tubing hanger and stinger assembly 15 particularly adapted for subsurface use in a well 16 such as an offshore oil and/or gas well. As shown schematically in FIG. 1, the well is provided with a well head 17 that is supported on an elevated platform 19 above sea level. Extending downwardly from the well head is a string of production tubing having an upper section 20 which telescopes into a casing 21 embedded in the sea floor and extending downwardly therefrom through various geological formations to a production strata (not shown). At the well head, a seal (not shown) is clamped to the upper end of the tubing string through connection to the platform 19 with the upper section 20 of the string typically being suspended from the platform by a surface hanger (not shown).

Figure 2A:
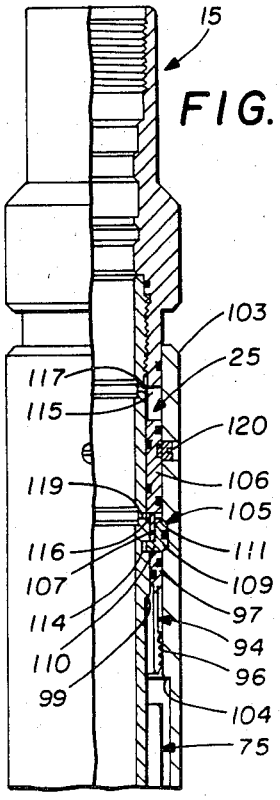
FIGS. 2A, 2B and 2C comprise a combined elevational and cross-sectional view of the tubing hanger and stinger assembly.
Figure 6A:
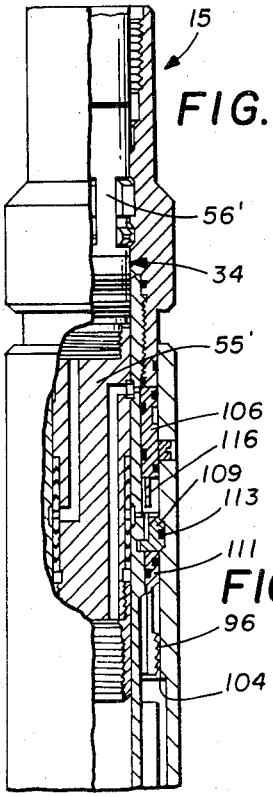
FIGS. 6A and 6B are combined elevational and cross-sectional views of the portion of the assembly embodying the stinger.
Figure 7A:
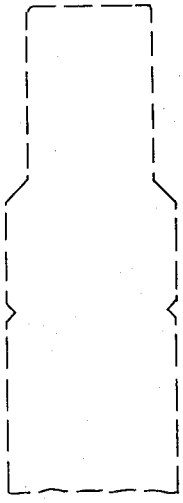
FIGS. 7A and 7B are combined elevational and cross-sectional views of the stinger shown in FIGS. 6A and 6B but with parts of the stinger in moved positions preparatory to separation of the stinger from the hanger.
Figure 7A:
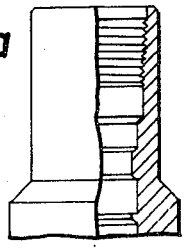
Figure 2C:
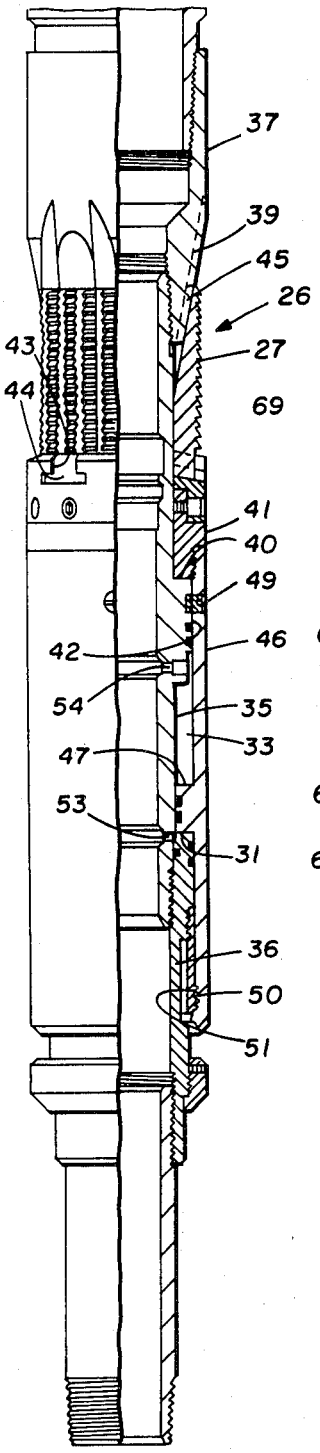
Figure 3:
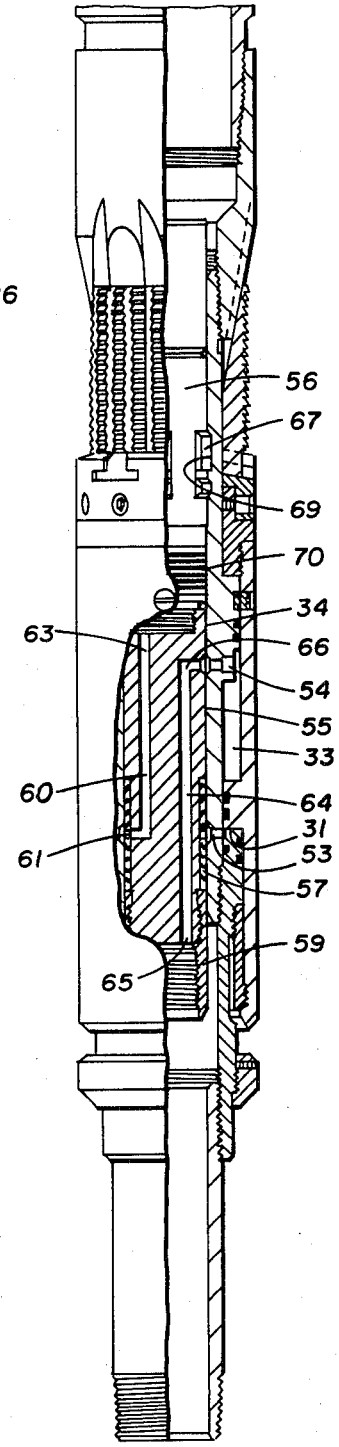
FIG. 3 is a combined elevational and cross-sectional view of the portion of the assembly comprising the tubing hanger with a wireline tool mechanism disposed within the tubing hanger in preparation for setting the tubing hanger slips.

Located within the casing below the mud line of the sea floor is a safety valve 23 provided as a means for shutting off fluid flow from the well in the event such action should become necessary. Absent the latter, the safety valve is maintained open by a control pressure supplied to the valve through a control line 24 extending between the platform and the valve. The tubing hanger and stinger assembly 15 is disposed in the tubing string beneath the safety valve 23 and includes a stinger 25 connecting with a subsurface hanger 26. When installed in the well 16, slips 27 in the hanger (see FIGS. 2C, 3 and 4) engage the inside surface of the well casing 21, in the present instance with one-way teeth to support a lower section 29 of the tubing string upwardly within the casing. Additional support for the lower section 29 of the string may be provided by a series of vertically spaced packers 30. The latter may be of a permanent or semi-permanent nature and disposed between the casing 21 and the tubing string 29 for the primary purpose of isolating production strata in the subsurface formations such as for the production of oil or gas.

For installation of the production string initially in the well with the lower section 29 of the string suspended from the subsurface hanger 26, the latter is lowered to a desired position in the casing 21 desirably close to the position in which the seals at the well head 17 may be seated properly. An expandable connection in the string such as between the safety valve 23 and the subsurface hanger 26 allows the well-head seals to be seated properly for the surface hanger to support the upper section 20 of the tubing string without also carrying a portion of the weight from the lower section 29 of the tubing string.

In accordance with one important aspect of the present invention enabling the subsurface hanger 26 to be set at its desired position in the casing 21, the hanger slips 27 are set hydraulically but yet are kept from being set unintentionally by random high pressure occurring in the tubing string. For these purposes, pressure equalizing means are provided in the hanger for normally maintaining equal pressures between slip actuating and retracting chambers 31 and 33 of the hanger and unique tool means 34 may be inserted and specifically located in the hanger to render the foregoing pressure equalizing means ineffective while at the same time providing communication between a source (not shown) of high hydraulic pressure and the slip actuating chamber 31 for causing the slips to be slid into their set positions. By virtue of this unique construction and the novel manner of setting the slips 27, the hanger 26 may be kept more readily from being installed at a position in the casing 21 other than at the desired location.

Figure 4:
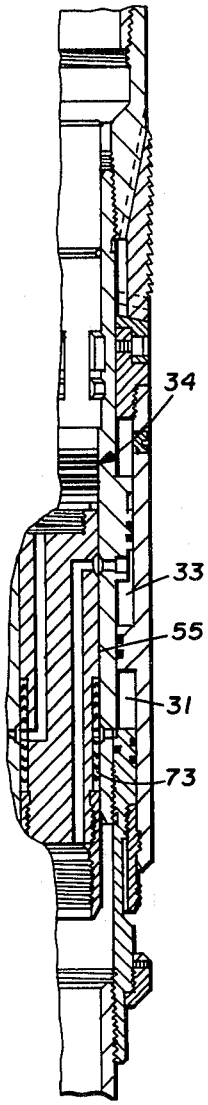
FIG. 4 is a fragmentary cross-sectional view of the hanger shown in FIG. 3 but with parts of the hanger in moved positions for setting the hanger slips.

More particularly in the present instance, the subsurface tubing hanger 26 includes a body in the form of a tubular mandrel 35 with a bottom connecter 36 threaded on the lower end thereof and a head 37 threaded on the upper end thereof. Herein, the head includes an inverted, generally frusto-conical section 39 an annular flange integrally formed with the mandrel intermediate the ends thereof protrudes radially outward to provide a shoulder 40. Mounted on the mandrel above the shoulder is a control ring 41 to which the individual segments of the slips 27 are attached. A number of T-slots 43 receive matching projections 44 from the slip segments thereby connecting the latter to the control ring 41. On the outer surface of the slip segments, one-way gripping teeth provide for supportive connection to the interior wall of the casing and a dovetail connection 45 is formed between the frusto-conical section 39 of the hanger head and the inside surfaces of the slip segments. With the slips mounted in the foregoing manner on the hanger head 37, when the control ring is slid upwardly on the mandrel 35, the slips are shifted radially outward in unison from retracted to set positions as shown in FIGS. 2C and 4, respectively. When moved downwardly, the control ring, of course, forces the slip segments to slide inwardly and thereby release the hanger from the inside wall of the casing.

To shift the control ring 41 from a lower position resting against the shoulder 40 upwardly to move the slip segments 27 from their retracted positions, an actuating member in the form of a setting cylinder 46 is telescoped over the mandrel with the upper end of the cylinder threadably connected to the control ring and a lower end portion extending downwardly around the bottom connecter 36. The cylinder is spaced radially outward from the mandrel by an annular sealing flange 47 integrally formed with the interior wall of the cylinder to slidably and sealingly engage with the exterior wall of the mandrel. The slip actuating and retracting pressure chambers 31 and 33 of the hanger are defined above and below the sealing flange by the space between the cylinder and the mandrel. When a predetermined pressure is reached in the actuating chamber over the pressure in the retracting chamber the setting cylinder is driven upwardly and in turn leaves the control ring to shift the slip segments radially outward.

The pressure differential required for initially moving the setting cylinder 46 upwardly on the mandrel 35 is determined by the strength of a series of shear pins 49 secured between the setting cylinder and the mandrel flange 42. Herein, four of the shear pins are connected through the setting cylinder to the mandrel at equal angularly spaced positions. Additional resistance to upward shifting of the setting cylinder is provided by a spring-fingered collet 50 secured to the bottom connecter 36 between the latter and the lower end portion of the setting cylinder. An annular recess 51 formed in the interior surface of the lower end portion of the setting cylinder receives the spring fingers of the collet with a snap fit.

Advantageously, herein, the means for normally maintaining equal pressures in the actuating and retracting chambers 31 and 33 are provided simply by first and second axially spaced ports 53 and 54 formed through the hanger mandrel so the two chambers communicate with each other through the open center of the mandrel. With this arrangement, it will be appreciated that the setting cylinder 46 will not be shifted by the pressure in the setting chamber regardless of the magnitude of such pressure.

To provide the pressure differential required between the actuating and retracting chambers for moving the setting cylinder 46, the tool means 34 includes a unique actuating spool 55 secured to a wireline tool 56 particularly adapted for positioning the spool within the hanger. Herein, the spool is generally cylindrical in shape and includes a series of stacked sealing rings 57 captivated on the lower end portion thereof by a retaining cap 59. Extending in a generally axial direction through the actuating spool is a high pressure passage 60 having a lower end 61 opening radially outward from the middle of the stack of sealing rings 57 to communicate with the first or slip-set port 53. An upper end 63 of the passage communicates with the hollow interior of the wireline tool 56 so that high pressure hydraulic fluid may be delivered from the well head 17 to pressurize the actuating chamber 31. For hydraulic fluid to be vented from the retracting chamber 33, a discharge passage 64 is formed through the actuating spool separately of the high pressure passage 60 and includes a lower end 65 opening from the lower end of the spool and an upper end 66 opening in a generally radial direction from this spool at a position spaced above the lower end 61 of the high pressure passage 60. The upper end of the discharge passage is positioned relative to the lower end 61 of the high pressure passage a distance equal to the spacing between the ports 53 and 54. So that when the lower end of the high pressure passage communicates with the actuating chamber 31, the discharge passage necessarily communicates with the retracting chamber 33 and the two chambers are sealed from communication with each other by the stacked sealing rings 57 positioned above the lower end of the high pressure passage.

To accurately position the actuating spool 55 in the hanger mandrel 35, the wireline tool 56 includes a plurality of angularly spaced positioning elements 67 which are carried thereby and configured to mate with a corresponding profile formed by a series of annular recesses cut in the interior wall of the mandrel 35. Secured to the wireline tool 56 beneath the positioning elements are packing rings 70 sized to engage the interior wall of the mandrel above the actuating spool to keep high pressure hydraulic fluid from passing between the tool and actuating spool into the retracting chamber 33 when the actuating chamber is being pressurized. Once the slips 27 are set by pressurizing the chamber 31, the wireline tool 56 and the actuating spool 55 should be pulled from the tubing string to keep the slips from being retracted by naturally created pressure in the well acting reversely through the discharge passage 64 to pressure the retracting chamber 33.

Figure 9:
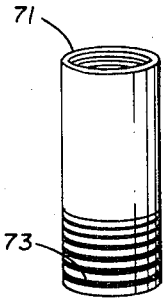
FIG. 9 is a perspective view of a retracting spool portion of the wireline tool mechanism.

To retract the slips 27 for moving the hanger 26 within the well casing 21, a retracting spool 71 replaces the actuating spool 55 on the lower end of the wireline tool 56. As shown in FIG. 9, like the actuating spool 55, the retracting spool 71 includes an exterior set of sealing rings 73 captivated thereon. But instead of having passages through the retracting spool, the latter is solid and the sealing rings 73 are located to begin at a position spaced downwardly from the upper end of the retracting spool a distance greater than the distance from the upper end of the actuating spool 55 to the upper end 66 of the discharge passage 64. Additionally, the width of the sealing band formed by the rings 73 is less then the distance between the two ports 53 and 54. Before attaching the retracting spool 71 to the line tool 56, the packing rings 70 are removed from the tool and, in this way, high pressure hydraulic fluid is free to flow between the line tool and the hanger mandrel 35 through the clearance passage provided between these parts and into the retracting chamber 33. Similarly, below the sealing rings 73, the clearance between the retracting spool and the interior wall of the mandrel provides an annular discharge passage from the actuating chamber 31.

With the retracting spool 71 in place, pressurization of the upper section 20 of the tubing string pressurizes the retracting chamber 33 to drive the setting cylinder 46 into its lower position and, in turn, retract the slips 27. In this position, the spring-fingered collet 50 snaps into the annular recess 51 holding the setting sleeve releasably within its lower position.

From the foregoing, it will be appreciated that the unique construction of the subsurface hanger 26 enables the slips 27 to be set easily yet without being set prematurely in a position other than a desired one. Moreover, further advantage is found in the ability of the present hanger to be reset using the retracting spool 71, thereby enabling the hanger to be accurately positioned to make full use of the expandable connection between the safety valve 23 and the hanger for proper setting of the seals at the well head 17.

In accordance with the primary aim of the present invention, the connection between the stinger 25 and the hanger 26 is constructed in a unique fashion allowing for length adjustment in the upper section 20 of the tubing string while also providing for easier separation of the stinger from the hanger than was possible heretofore. For these purposes, an elongated tubular expansion member 74 is connected to the head 37 of the hanger and a lower end portion 75 of the stinger is telescoped sealing with the member for movement between extended and collapsed positions thereby allowing for adjustment in the length of the upper section 20 of the tubing string. By virtue of this construction, the stinger may be pulled straight from the hanger should it be necessary to remove the upper section of the tubing string for servicing a safety valve 23. Moreover, by constructing the tubing hanger and stinger assembly 15 in the foregoing fashion, the overall assembly is of a simplified construction enabling quicker and easier adjustment of the length of the upper section 20 of the tubing string for proper setting of the seals at the well head when installing the tubing string for production purposes.

In the present instance, the tubular expansion member or receptacle 74 is connected by mating threads to the hanger head 37 at the lower end of the receptacle and the upper end of the head. The stinger 25 comprises a body 76 whose lower end portion is telescoped into the upper end portion of the receptacle and is slidably captivated therein by a releasable catch 77 formed between the stinger body 76 and the receptacle. To seal the lower end portion of the stinger within the receptacle, a plurality of annular stacked sealing members or rings 79 are captivated on the lower end portion of the stinger body between an annular rib 80 which is integrally formed with the stinger body and a retaining ring 81 threaded on the lower end of the stinger body.

Figure 2B:
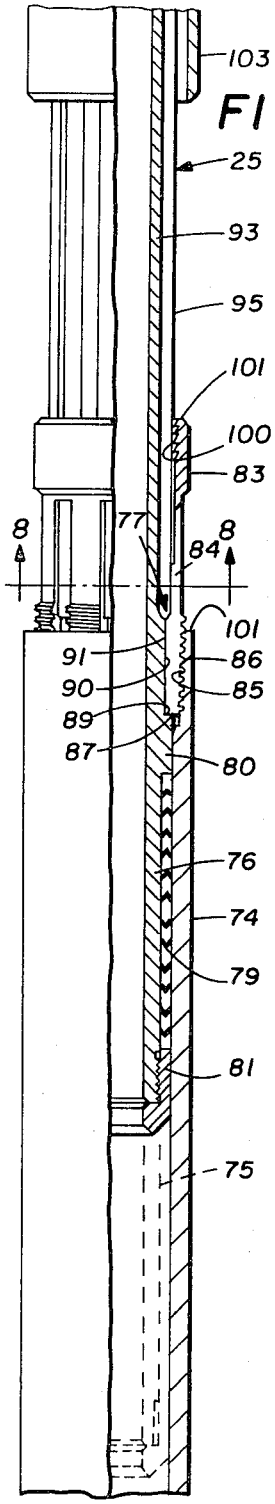
Figure 6B:
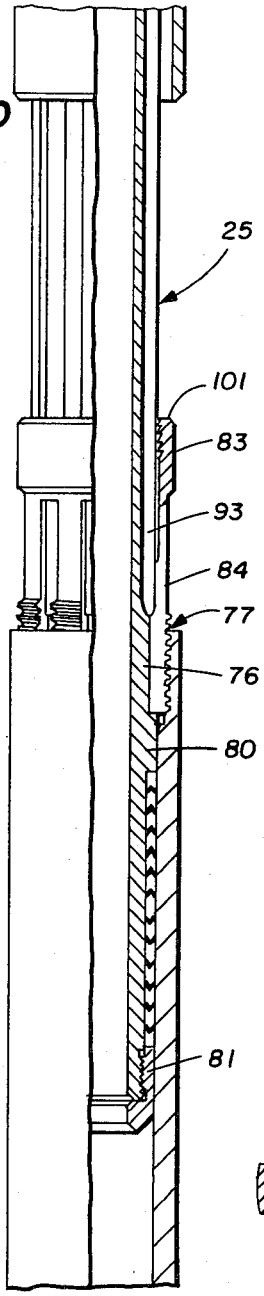

As shown in FIG. 2B, the catch 77 holds the stinger against axial separation from the receptacle 74 and thus enables the stinger and hanger to be lowered into the well 16 as a unit such as when initially preparing the well for production. More specifically, the catch 77 includes a slide collar 83 telescoped over the stinger body 76 and including a plurality of angularly spaced spring fingers 84 depending therefrom to fit between the stinger body and an internally threaded section 85 of the upper end of the receptacle 74. Integrally formed with and facing outwardly from the free ends of the spring fingers are axially spaced teeth 86 sized to mate with the internally threaded section 85 of the receptacle. Lower ends 87 of each of the spring fingers extend radially inward beyond the interior wall of the receptacle 74 for abutting engagement with an upper edge 89 of the annular rib 80. In this way, the receptacle 74 is supported upwardly on the stinger to be carried thereby such as when lowering the hanger 26 in the well 16 and to provide a stop for limiting upward movement of the stinger body 25 relative to the receptacle except for when the catch 77 is placed in an unlocked condition for the separation of the stinger body from the receptacle. With the stinger in its extended position in the receptacle with the edge 89 abutting the lower ends of the fingers 87, an annular section 90 of the stinger body is positioned closely adjacent the backside 91 of each of the spring fingers 84 so as to prevent the spring fingers from flexing radially inward to separate the teeth 86 from the internally threaded section 85 of the receptacle 74.

Figure 7B:
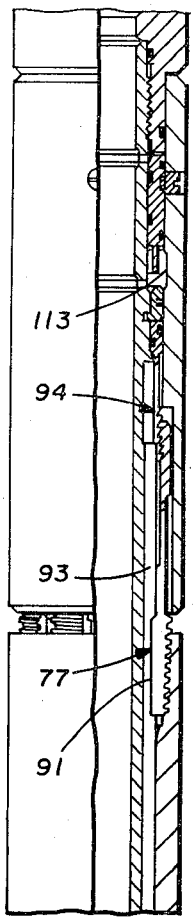
Figure 8:
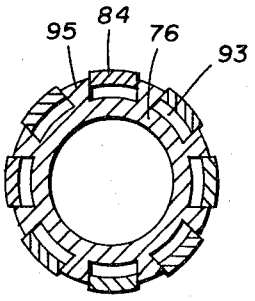
FIG. 8 is a cross-sectional view taken substantially along line 8—8 of FIG. 2B.

For straight pull removal of the stinger 25 from the receptacle 74, the stinger body is telescoped downwardly into the receptacle 74 into a fully collapsed position within which the section 90 of the stinger body is spaced axially from the backside 91 of the spring fingers 84 to allow the fingers to flex radially inwardly into axially extending grooves 93 which are formed in the stinger body 76. In this position, (see FIG. 7B) a latch 94 with interfitting parts carried on the upper end portion of the stinger body and formed in the collar 83 may be connected together to hold the slide collar upwardly on the stinger body in a position for releasing the catch 77. Accordingly, with the collar secured to the upper end portion of the stinger body, when the stinger is pulled upwardly within the receptacle, the spring fingers 84 are cammed radially inward and pulled out of the receptacle with a straight pull on the stinger.

Advantageously, the stinger 25 also may be removed from the receptacle 74 by rotating the upper section 20 of the tubing string in a direction tending to tighten the threaded joints in the pipe sections forming the tubing string. For rotational removal of the stinger from the receptacle, the mating threads 84 and 85 on the spring fingers and receptacle, respectively, are formed as left-hand helical threads instead of the usual right-hand helical threads of connecting pipe joints. Additionally, an axially extending rib 95 protrudes radially outward from the stinger body and is integrally formed therewith to fit in the spaces between each of the spring fingers 84 thereby to provide a reaction surface for rotating the slide collar 83 relative to the receptacle 74 when the slips 27 of the hanger 26 have been set to prevent the receptacle from turning with the upper section 20 of the tubing string.

As shown in FIG. 2A, one part of the latch 94 is comprised of a collet having a number of resilient latching fingers 96 depending from a ring member 97 supported upwardly on the stinger body 76 by an annular shoulder 99 formed around the upper end portion thereof. More particularly, the latching fingers 96 are adapted to interlock with latching teeth 100 in the collar 83. Specifically, the teeth are formed on the inside wall of the collar adjacent the upper edge 101 thereof so as to interlock for lifting support with the fingers 96.

For initial installation and during reassembly of the stinger 25 with the receptacle 74 such as after servicing the safety valve 23, the latching fingers 96 are protected by a cylindrical member or setting sleeve 103 which is telescoped over the collet around the upper end portion of the stinger body. Herein, the setting sleeve extends downwardly alongside the latching fingers 96 with an annular ledge 104 formed on the inside wall of the sleeve and normally positioned beneath the ring member 97 level with the lower ends of the fingers to keep the slide collar from telescoping alongside the fingers to interlock the latching teeth 100 with the fingers 96.

In accordance with a more detailed feature of the present invention, a unique locking mechanism 105 normally supports the sleeve 103 in its lower position but may be actuated hydraulically to release the sleeve for sliding into an upper position when engaged by the upper edge 101 of the slide collar 83. Normally, telescoping of the stinger 25 downwardly into the receptacle 74 is limited by abutting engagement of the internal ledge 104 of the sleeve with the upper edge 101 of the collar 83 and, when the receptacle and stinger are reassembled, such as after servicing the safety valve 23, this construction feature is utilized to drive the collar downwardly so the spring fingers 84 of the catch 77 latch with the internally threaded section 85 of the receptacle 74. For supporting sleeve in its lower position on the stinger body 76, the locking mechanism includes an annular piston 106 sealed between the stinger body and sleeve. Intergrally formed with the piston and extending downwardly therefrom is an annular skirt 107. The skirt is telescoped between the stinger body and a plurality of angularly spaced dogs 109 disposed radially outward of the stinger body. Each of the dogs includes an inwardly directed radial leg 110 and an upwardly extending segment 111 integrally formed therewith and extending upwardly therefrom in a generally axial direction. The skirt holds the dog segments radially outward to seat within an annular recess 113 which is formed in the interior wall of the setting sleeve 103. Formed in the stinger body radially inward of the legs 110 is an annular slot 114 and within which the legs are partially received when the dogs are disposed within their radially outward position. The space between the setting sleeve 103 and the stinger body on opposite sides of the piston 106 defines upper and lower pressure chambers 115 and 116, respectively. These chambers are communicated to the interior of the stinger body by axially spaced upper and lower bores 117 and 119 formed through the stinger body. When the pressure in the lower chamber 116 is substantially greater than the pressure in the upper chamber, a shear pin 120 extending through the sleeve and into the piston 106 is broken by the upward force on the piston 106 as the latter is shifted upwardly into the upper pressure chamber 115. As the piston moves upwardly, the skirt 107 is withdrawn from between the dogs 109 and the stinger body so that when the ledge 104 is forced against the upper edge 101 of the collar 83, the sleeve will be forced upwardly camming the dogs inwardly and exposing the latching fingers 96 to interlock with the latching teeth 100.

Preferably, hydraulic pressure is selectively applied to the lower chamber 116 of the locking mechanism 105 in a fashion substantially identical with the way in which hydraulic pressure is supplied to the actuating chamber 31 for the slips 27 as described herein before using a wire line tool 56' with an actuating spool 55' connected thereto. Herein, the primed reference numbers used indicate parts of substantial functional identity with those earlier described herein and for which detailed description thereof is admitted for brevity.

In view of the foregoing, it will be seen that the present invention brings to the art a new and improved hanger and stinger assembly 15 arranged in a novel fashion to include an expandable joint therebetween with the stinger slidably adjustable for length within the tubular receptacle 74 of the hanger 26. Further, means are provided within the assembly for separating the stinger and hanger either with a straight pull operation or by turning the stinger to thread loose from the receptacle. For the straight pull operation, the latching mechanism 94 is utilized to hold the releasable catch 77 in a position enabling the stinger body 76 to be pulled from the receptacle 74.

The embodiments of the invention in which an exclusive property or privilege is claimed are defined as follows:

1. In combination, a hanger for a tubing string including a tubular body having opposite ends, a head with an inverted, generally frusto-conical section connected to one end of said body, a series of slip segments slidably mounted on said one end and engaging said frusto-conical section for generally radial movement relative to said body when sliding upon said frusto-conical section, means for sliding said segments on said section between retracted and set positions in response to hydraulic pressure, a tubular expansion receptacle connected to said head, a stinger having a hollow body telescoped with said receptacle, means slidably connecting said stinger with said receptacle for selective adjustment of the overall exterior length of said receptacle and said stinger together, means carried by one of said stinger and receptacle for sealing against pressure fluid loss therebetween, a releasable catch in said slidable connecting means movable between a lock position for holding the stinger against axial separation from said receptacle and an unlocked position releasing said stinger for axial separation from said receptacle, and a latch carried by said stinger body for holding said releasable catch in its unlocked position so said stinger may be separated axially from said receptacle by a straight pull.

2. In combination, a hanger for a tubing string including a mandrel having an axial opening and opposite ends, a head with an inverted, generally frusto-conical section connected to one end of said mandrel, a series of slip segments slidably mounted on said one end and engaging said frusto-conical section for generally radial movement relative to said mandrel when sliding upon said frusto-conical section, means for sliding said segments on said section between retracted and set positions in response to hydraulic pressure, an elongated tubular expansion receptacle having a lower end section threadably secured to said head and an internally threaded upper end section, a stinger including an elongated tubular body having a lower end portion telescoped into said receptacle and a protruding end portion extending upwardly from said receptacle, said body being movable between extended and collapsed positions within said receptacle, an annular rib on said body spaced upwardly from the lower end thereof and extending outwardly therefrom in a generally radial direction, a plurality of annular sealing members encircling said lower end portion beneath said rib, a retaining ring threaded onto the lower end portion of said body and forming a shoulder spaced beneath said rib to capture therebetween said sealing members on said body, a collar telescoped onto said body above said rib and including an upper edge and a plurality of angularly-spaced downwardly extending spring fingers with free ends normally disposed for abutment with said rib, a series of axially spaced teeth formed on and facing radially outward from the free ends of said spring fingers, said teeth latching with said receptacle in said internally threaded upper end section, said rib abutting said free ends of said spring fingers with said stinger body in said extended position and thereby limiting upward movement of said body within said receptacle, a plurality of axially extending, circumferentially-spaced grooves formed in said stinger body with said grooves in angular registry with said spring fingers, said grooves further each having a lower terminus spaced upwardly from said rib and being of a radial depth to receive its associated finger when the latter is flexed radially inward thereby to release said teeth from said threaded upper end section of said receptacle, a section of said body defined between said termini and said rib and supporting said fingers against radially inward flexure thereof when aligned axially therewith in said extended position of said body, a setting sleeve mounted on said protruding end portion of said body and having an annular shoulder formed thereon to engage said upper edge of said collar to force the latter downwardly so said spring fingers telescope with a snap-fit into said upper end section of said receptacle when initially connecting said stinger together with said receptacle, a collet with a set of resilient latching fingers telescoped between said body and said setting sleeve, said collar having an internal latching surface for mating with said latching fingers to lock said stinger body in a collapsed position with said grooves disposed radially relative to said spring fingers for the latter to flex radially inwardly to release said stinger from said receptacle when lifted relative to the latter, locking mechanism connected between said setting sleeve and said stinger body and normally supporting said sleeve in a lower position on said stinger body relative to said resilient latching fingers, and said mechanism further including an annular piston sealed between said stinger body and said sleeve and having a depending annular skirt integrally formed therewith, a series of angularly-spaced dogs each having an inwardly directed radial leg and a segment integrally formed therewith and extending upwardly therefrom in a generally axial direction, an annular recess formed in the interior wall surface of said setting sleeve and receiving said segments, said skirt normally extending between said segments and said stinger and thereby captivating said segments in said recess, an annular slot formed in the exterior surface of said stinger body with said dog legs being partially received therein, a first pressure chamber on one side of said piston and a second pressure chamber on the other side of said piston and sealed from each other, pressure-equalizing means for normally keeping the hydraulic pressures within said chambers substantially equal to avoid unintentional shifting of said piston within said chambers even though the chambers may be subjected to high pressures, and tool means positionable in said body for rendering said pressure-equalizing means ineffective and for communicating high hydraulic pressure to one of said chambers to the exclusion of the other of said chambers and thereby cause said piston to slide within said chambers and thereby move said skirt from alongside said dog segment and release said dogs for sliding radially inward to allow said sleeve to be shifted into its upper position.

3. A subsurface tubing hanger and stinger assembly for use in a tubing string in a well to enable reinstallation of a safety valve in the tubing string above the hanger without disturbing the tubing string suspended from the hanger, said hanger including a tubular mandrel with an upper end and a lower end adapted for supportive connection to the tubing string, a hanger head connected to said upper end and having an inverted, generally frustoconical outer surface, a plurality of slip segments angularly spaced from each other and slidably connected to said outer surface for movement radially relative to said mandrel between retracted and set positions, hydraulic actuating means for sliding said segments between said retracted and set positions, a tubular receptacle on said head and opening upwardly therefrom, a tubular stinger slidably telescoped with said receptacle for movement between extended and collapsed positions relative thereto for adjusting the overall vertical length of said assembly, a slide seal connected between said receptacle and said stinger for sealing against pressure leakage between said stinger and said receptacle, a catch located between said stinger and said hanger and movable between a locked position connecting said stinger and said hanger together against axial separation and an unlocked position releasably connecting said stinger and said hanger together for axial separation upon application of predetermined lifting force to said stinger, a latch mounted on the stinger and connectable with said catch to hold the latter in its unlocked position.

4. A hanger and stinger assembly as defined by claim 3 further including a stop normally adapted for engagement between said stinger and said receptacle to limit upward movement of said stinger relative to said receptacle.

5. A hanger and stinger assembly as defined by claim 4 wherein said stop comprises an annular rib connected to one of said stinger and receptacle and an abutment surface connected to the other of said stinger and receptacle for engagement with said rib to normally locate said stinger in its extended position.

6. A hanger assembly as defined by claim 3 wherein said catch comprises a collar connected to said stinger and having a plurality of depending spring fingers with free ends adapted to connect as a threadable snap-fit within said receptacle.

7. A hanger assembly as defined by claim 6 including an axial extending ridge formed on said stinger and extending radially outward thereof between each of said spring fingers to provide a rotational drive connection between said spring fingers and said stinger for unthreading said spring fingers from said receptacle.

8. A hanger assembly as defined by claim 6 wherein said stinger is telescoped into said receptacle and includes an annular rib normally disposed within said receptacle for abutting engagement with said free ends of said spring fingers to limit upward movement of said stinger within said receptacle to said extended position.

9. A hanger assembly as defined by claim 8 wherein said catch further includes a section of said stinger disposed closely adjacent said spring fingers when in said extended position and preventing radially inward flexure of said spring fingers.

10. A hanger assembly as defined by claim 9 including a plurality of grooves formed in the exterior surface of said stinger and extending in a generally axial direction, said grooves being associated one with each of said fingers to receive said fingers upon being flexed radially inward when disconnecting said stinger from said receptacle.

11. A hanger assembly as defined by claim 3 including an element secured to said stinger and spaced upwardly from said catch for abutting engagement with said catch when recoupling said stinger with said receptacle to drive said catch into position for locking said stinger within said receptacle.

12. A hanger assembly as defined by claim 11 wherein said element comprises a setting sleeve connected to and surrounding the upper end portion of said stinger.

13. A hanger assembly as defined by claim 3 including hydraulically-actuated means for setting said latch to connect with said catch when said stinger is lowered toward its collapsed position in said receptacle.

14. A hanger assembly as defined by claim 13 wherein said latch comprises a collet with a first part mounted on the upper end portion of said stinger and a mating part mounted on said catch, a setting sleeve movable between a normally blocking position wherein said parts are kept from connecting together and a retracted position exposing one of said parts for mating engagement with the other.

15. A hanger assembly as defined by claim 14 wherein said setting sleeve is connected to and surrounds the upper end portion of said stinger, said first part of said collet is disposed between said sleeve and said stinger, said assembly further including locking mechanism connected between said setting sleeve and said stinger and normally supporting said sleeve in its blocking position with said first part position above the lower end of said setting sleeve.

16. A hanger assembly as defined by claim 15 wherein said locking mechanism includes an annular piston sealed between said stinger and said sleeve and having a depending annular skirt integrally formed therewith, a series of angularly-spaced dogs each having an inwardly directed radial leg and a segment integrally formed therewith and extending in an axial direction, an annular recess formed in the interior wall surface of said setting sleeve and receiving said segments, said skirt normally extending between said segments and said stinger and thereby captivating said segments in said recess, an annular slot formed in the exterior surface of said stinger with said dog legs being partially received therein, said dogs releasing said sleeve to slide into its retracted position when said skirt is lifted by said piston from between said segments and said stinger.

17. A hanger assembly as defined by claim 16 further including means for moving said piston between said stinger and said sleeve including a first pressure chamber on one side of said piston and a second pressure chamber on the other side of said piston and sealed from each other, pressure-equalizing means for normally keeping the hydraulic pressures within said chambers substantially equal to avoid unintentional shifting of said piston within said chambers even though the chambers may be subjected to high pressure, and tool means positionable in said stinger for rendering said pressure-equalizing means ineffective and for communicating high hydraulic pressure to one of said chambers to the exclusion of the other of said chambers and thereby cause said piston to slide within said chambers and thereby free said sleeve for being shifted into its retracted position.

* * * * *